US007012586B2

(12) United States Patent
Kageyama et al.

(10) Patent No.: US 7,012,586 B2
(45) Date of Patent: Mar. 14, 2006

(54) IMAGE DISPLAY DEVICE

(75) Inventors: Hiroshi Kageyama, Hachioji (JP); Hajime Akimoto, Ome (JP)

(73) Assignees: Hitachi, Ltd., Tokyo (JP); Hitachi Displays, Ltd., Chiba-ken (JP)

( * ) Notice: Subject to any disclaimer, the term of this patent is extended or adjusted under 35 U.S.C. 154(b) by 78 days.

(21) Appl. No.: 10/775,114

(22) Filed: Feb. 11, 2004

(65) Prior Publication Data

US 2005/0088103 A1 Apr. 28, 2005

(30) Foreign Application Priority Data

Oct. 28, 2003 (JP) ..... P2003-367138

(51) Int. Cl.
*G09G 3/30* (2006.01)
*G09G 5/00* (2006.01)

(52) U.S. Cl. ..... 345/77; 345/76; 345/80; 345/206; 345/210; 345/690; 315/169.1; 315/169.3

(58) Field of Classification Search .. 315/169.1–169.4; 345/55, 76, 77, 205, 206, 690, 208, 210, 345/80

See application file for complete search history.

(56) References Cited

U.S. PATENT DOCUMENTS 6,323,851 B1 * 11/2001 Nakanishi ..... 345/211
6,480,189 B1 * 11/2002 Ide ..... 345/211
2003/0184538 A1 * 10/2003 Yamamoto et al. ..... 345/211
2004/0080473 A1 * 4/2004 Higuma et al. ..... 345/76
2005/0007328 A1 * 1/2005 Yamazaki et al. ..... 345/89
2005/0062691 A1 * 3/2005 Tamura et al. ..... 345/76
2005/0068270 A1 * 3/2005 Awakura et al. ..... 345/76

FOREIGN PATENT DOCUMENTS

JP 2000-56847 * 8/1998
JP 2000-056847 * 2/2000

* cited by examiner

*Primary Examiner*—Tuyet Vo
*Assistant Examiner*—Leith Al-Nazer
(74) *Attorney, Agent, or Firm*—Reed Smith LLP; Stanley P. Fisher, Esq.; Juan Carlos A. Marquez, Esq.

(57) ABSTRACT

The present invention provides an image display device that reduces variations in brightness of the light emitting elements included in the device due to a voltage drop on the power source line of the device and TFT threshold voltage variations and displays good quality images. The image display device is equipped with a pixel circuit voltage detecting means to selectively output a voltage internal to a pixel circuit included in each of a plurality of pixels of the device to a signal line to which the pixel circuit connects. Its drive circuit is equipped with a voltage addition means to add the signal line voltage and a signal voltage corresponding to image data to be displayed and output a sum voltage to the signal line again.

16 Claims, 11 Drawing Sheets

IMAGE DISPLAY DEVICE

BACKGROUND OF THE INVENTION

1. Field of the Invention

The present invention relates to image display devices and, more particularly, to an image display device in which a light emitting element is used in a pixel.

2. Description of the Prior Art

As an image display device employing light emitting elements for pixels, an EL display using electro-luminescence (hereinafter abbreviated to EL) elements has been reported. Besides, in an active matrix type EL display, wiring lines for signal and current transmission are formed in the shape of a matrix and pixel circuits are respectively built into pixels, wherein each pixel circuit is formed of thin-film transistors (hereinafter abbreviated to TFTs) which are active elements besides a light emitting element.

There are two methods of controlling the light emitting brightness of an EL element: a method in which voltage supplied to the EL element through the pixel circuit is controlled and a method in which current supplied to the EL element is controlled. Since the light emitting brightness of the EL element changes in proportion to the current flowing across the EL element, the method in which the current is controlled is advantageous in that it can provide stable control of the light emitting brightness. Such a method of controlling the light emitting brightness of an EL element by controlling the current flowing across the EL element is disclosed in JP2000-56847A.

A conventional pixel circuit equipped with an EL element is shown in FIG. 13. This pixel circuit of prior art is comprised of a resistor 101, p-channel TFTs 102 and 103, a TFT switch 104, a power source line 105, and a capacitor 106, and an EL element 108 and a ground electrode 107 are connected to the pixel circuit. When the TFT switch 104 is turned on and a voltage signal is applied to an input terminal 109, current flows across the resistor 101 and, at the gate electrode of a p-channel TFT 102, a gate voltage depending on a drain current is generated. The gate voltage is held on the capacitor 106. Current i that flows at this time is obtained by Equation 1 below, where Vdd is a voltage on the power source line 105, Vin is a voltage supplied to the input terminal 109, Vds is a drain-source voltage of the TFT 102, and R is a resistance value of the resistor 101.

$$i=(Vdd-Vds-Vin)/R \quad \text{(Equation 1)}$$

Because the p-channel TFTs 102 and 103 constitute a current mirror circuit, the current i also occurs between the source and drain electrodes of the p-channel TFT 103 and also flows into the EL element 108. Then, even if the TFT switch 104 is turned OFF, the p-channel TFT 103 continues to supply the current i to the EL element 108, independent of the voltage at the input terminal 109, because the capacitor 106 holds the gate voltage of the TFT 103.

Thus, the pixel circuit shown in FIG. 13 is able to flow the current obtained by Equation 1 into the EL element 108 by controlling the voltage Vin supplied to the input terminal and, besides, is able to keep the current flowing across the EL element 108 by the gate voltage held by the capacitor 106. Since the light emitting brightness of the EL element 108 is proportional to the current flowing across the EL element 108, the light emitting brightness of the EL element 108 can be controlled by controlling the voltage Vin supplied to the input terminal. A huge number of pixel circuits identical to the above pixel circuit including the EL element are arrayed in two dimensions and the signal voltage Vin is input in order to the input terminal of each pixel circuit; thereby, an image can be displayed. As the EL element whose light emitting brightness changes in proportion to the quantity of the current flowing across it, an organic EL diode is known.

SUMMARY OF THE INVENTION

Conventional image display devices have an array of a plurality of pixel circuits like the pixel circuit shown in FIG. 13. However, for the corresponding TFTs 102 in the plurality of pixel circuits, values of the drain-source voltage Vds may vary even if the same current flows through the TFTs 102. This is due to variations in performance of the individual TFT components installed in the pixel circuits. Furthermore, because the plurality of pixel circuits connect to one power source line 105, a voltage drop may occur due to wiring resistance inherent to the power source line 105 and the voltage Vdd on the power source line 105 may decrease in some of the pixel circuits. For an image display device having a large screen, the power source line is long and, consequently, such voltage drop becomes significant.

Since the light emitting brightness of the EL element 108 is proportional to the current i obtained by Equation 1, this brightness is directly influenced by Vds variations and Vdd decrease. In an image display device using the pixel circuits exemplified in FIG. 13, when the EL element brightness per pixel is influenced as above, unevenness in lightness is observed on an image displayed, which degrades the image quality.

It is therefore an object of the present invention to provide an image display device in which such image quality degradation does not occur.

In one aspect, the present invention is an image display device comprising an image display portion in which a plurality of pixels are arranged in a matrix, a plurality of signal lines wired in the image display portion to carry a voltage signal to the pixels, and a drive circuit to control voltage on each signal line, wherein each pixel comprises a light emitting element and a pixel circuit which controls the intensity of light emission of the light emitting element, characterized in that the image display device is equipped with a pixel circuit voltage detecting means to selectively output a voltage internal to the pixel circuit included in each pixel to the signal line to which the pixel circuit connects and that the drive circuit is equipped with a voltage addition means to add the voltage on the signal line and a signal voltage corresponding to image data to be displayed and output a sum voltage to the signal line again.

Preferably, the pixel circuit voltage detecting means comprises circuitry which can place the pixel circuit included in each pixel in three states: a disconnection state from the signal line, a connection state to the signal line, and a resistive connection state wherein the pixel circuit connects to the signal line with a sufficiently higher value of resistance than in the connection state.

The pixel circuit voltage detecting means also may comprise a resistor and switching transistors connected in parallel to the resistor to close and open a short circuit across the resistor.

It is also preferable to equip the pixel circuit with a current holding circuit to supply a constant current to the light emitting element.

Besides, the drive circuit may comprise a sampling circuit to hold the voltage on the signal line and an adder circuit to add the voltage thus held and an image signal voltage. The drive circuit also may comprise a driver IC to output an analog voltage and a capacitor connected between the driver IC and the signal line.

In another aspect, the present invention is an image display device comprising an image display portion in which a plurality of pixels are arranged in a matrix, a plurality of signal lines wired in the image display portion to carry a voltage signal to the pixels, and a drive circuit to control an analog voltage on each signal line, wherein each pixel comprises a light emitting element and a pixel circuit which controls the intensity of light emission of the light emitting element, characterized in that the image display device further includes a plurality of resistive wiring lines having a higher value of resistance than the signal lines and wired in parallel with the signal lines, a plurality of first switching means to control connection between each signal line and each resistive wiring line, and a plurality of second switching means to control connection between each resistive wiring line and each pixel circuit.

In this case, it is preferable to equip the drive circuit with a voltage addition means to add the voltage on the signal line and a signal voltage corresponding to image data to be displayed and output a sum voltage to the signal line again.

It is also preferable to equip the image display device with a control circuit which controls the first and second switching means to change a value of resistance between the signal line and the pixel circuit in at least two levels.

Furthermore, the signal line and the resistive wiring line may be formed so as to be overlapped in a region and isolated by an insulation layer which is formed therebetween.

Also, the resistive wiring line may be made of a polycrystalline silicon thin film.

Furthermore, it is preferable to configure the pixel circuit constituent elements with thin-film transistors and the thin-film transistors may be formed as either n-channel ones only or p-channel ones only.

According to the present invention, the image display device that reduces variations in brightness of the light emitting elements due to a voltage drop on the power source line and TFT threshold voltage variations and displays good quality images can be realized.

The above advantages and other advantages, objects, and features of this invention will be apparent from the following detailed description with reference to the accompanying drawings, as well as in the appended claims.

DETAILED DESCRIPTION OF THE PREFERRED EMBODIMENTS

<Embodiment 1>

Figure 1:
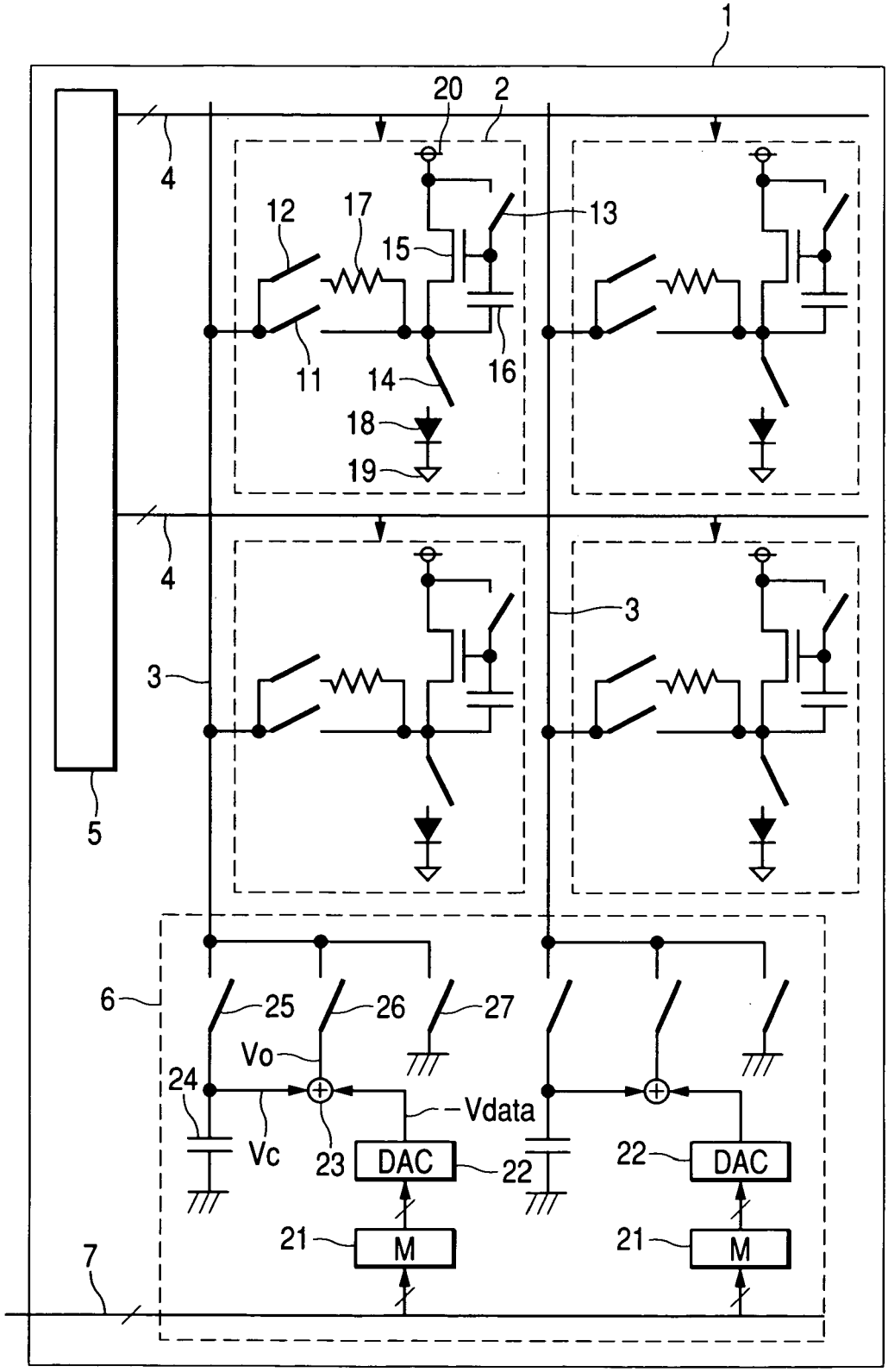
FIG. 1 is a circuitry diagram showing a preferred Embodiment 1 of the image display device according to the present invention.

FIG. 1 is a circuitry diagram showing a preferred Embodiment 1 of the image display device according to the present invention. On a glass substrate 1, a plurality of pixel circuits 2, a plurality of signal lines 3, a plurality of scan buses 4, and a scanning circuit 5 are formed.

The pixel circuits 2 are arranged in a matrix of two columns by two rows. The reason why the number of the pixel circuits 2 is 2×2=4 is merely for simplifying explanation. For, for example, a screen resolution of a color Video Graphics Array (VGA), the number of pixels could be 1920 columns (640 columns×3 colors) by 480 rows. Each signal line 3 connects to individual pixel circuits 2 arranged in one column and each scan bus 4 connects to individual pixel circuits 2 arranged in one row. The scanning circuit 5 connects to all the scan buses 4 and outputs signals to the scan buses 4. In addition, a driver IC 6 is bonded on the surface of the glass substrate 1 and has connections to the signal lines 3. The driver IC 6 receives an image signal that is input from the external through a cable 7.

A pixel circuit 2 is comprised of TFT switches 11 to 14, a current-controlling TFT 15, a capacitor 16, a resistor 17, and an EL element 18. The capacitor 16 is connected between the gate and source electrodes of the current-controlling TFT 15 and has a function to hold a gate-source voltage Vgs. A TFT switch 13 is connected between the drain and gate electrodes of the current-controlling TFT 15 and controls whether to supply a voltage on the drain electrode to the gate electrode and the capacitor 16. The drain electrode of the current-controlling TFT 15 is connected to a power source line 20 and is supplied with current from the power source line 20. The source electrode of the current-controlling TFT 15 is connected to three TFT switches 11, 12, and 14. A TFT switch 11 makes a connection between one of the plurality of signal lines 3 and the current-controlling TFT 15 and takes a role to allow current that flows through the current-controlling TFT 15 to flow directly into the signal line 3 when it is ON. A TFT switch 12 makes a connection between the one of the signal lines 3 and the current-controlling TFT 15 via the resistor 17 in series with it and takes a role to generate a current in proportion to a voltage across the resistor 17 when it is ON. A TFT switch 14 makes a connection between the anode of the EL element 18 and the current-controlling TFT 15 and takes a role to supply the current flowing through the current-controlling TFT 15 to the EL element 18 when it is ON. The cathode of the EL element 18 is connected to a ground electrode 19.

Although omitted in FIG. 1, it is assumed that the TFT switches 11 to 14 are connected to a scan bus 4 and ON/OFF states of the switches are controlled by a signal carried on the scan bus 4. All the plurality of scan busses 4 are connected to the scanning circuit 5 and the scanning circuit 5 has a function to generate logic signals to control ON/OFF of the TFT switches 11 to 14 and supply these signals through the scan busses 4.

The driver IC 6 is comprised of memory (M) elements 21, DA converters (DAC) 22, adder circuits 23, capacitors 24, and switches 25 to 27. The driver IC 6 has the connections to all the signal lines 3 and is made up of same parallel circuit arrangements per signal line. All the plurality of memory elements 21 are connected to the cable 7 and have a function to distribute and store a digital image signal that is input through the cable 7. A DA converter 22 is connected to a memory element 21 and has a function to convert a digital image signal stored on the memory element 21 into an analog voltage. A capacitor 24 and a switch 25 constitute a sampling circuit and the capacitor 24 takes a role to sample and hold a voltage on the signal line 3 when the switch 25 is ON. An adder circuit 23 adds an output voltage "−Vdata" from the DA converter 22 and a voltage Vc on the capacitor 24 and generates a sum voltage Vo. A switch 26 makes a connection between the adder circuit 23 and the signal line 3 and the sum voltage Vo is output to the signal line 3 when the switch 26 is ON. A TFT 27 is a switch to drop the voltage on the signal line 3 to a voltage that is sufficiently lower than a voltage on the power source line 20. All or part of the functions of the memory elements 21, DA converters 22, adder circuits 23, capacitors 24, and switches 25 to 27 constituting the driver IC 6 may be configured with TFTs and formed on the glass substrate 1.

Figure 2:
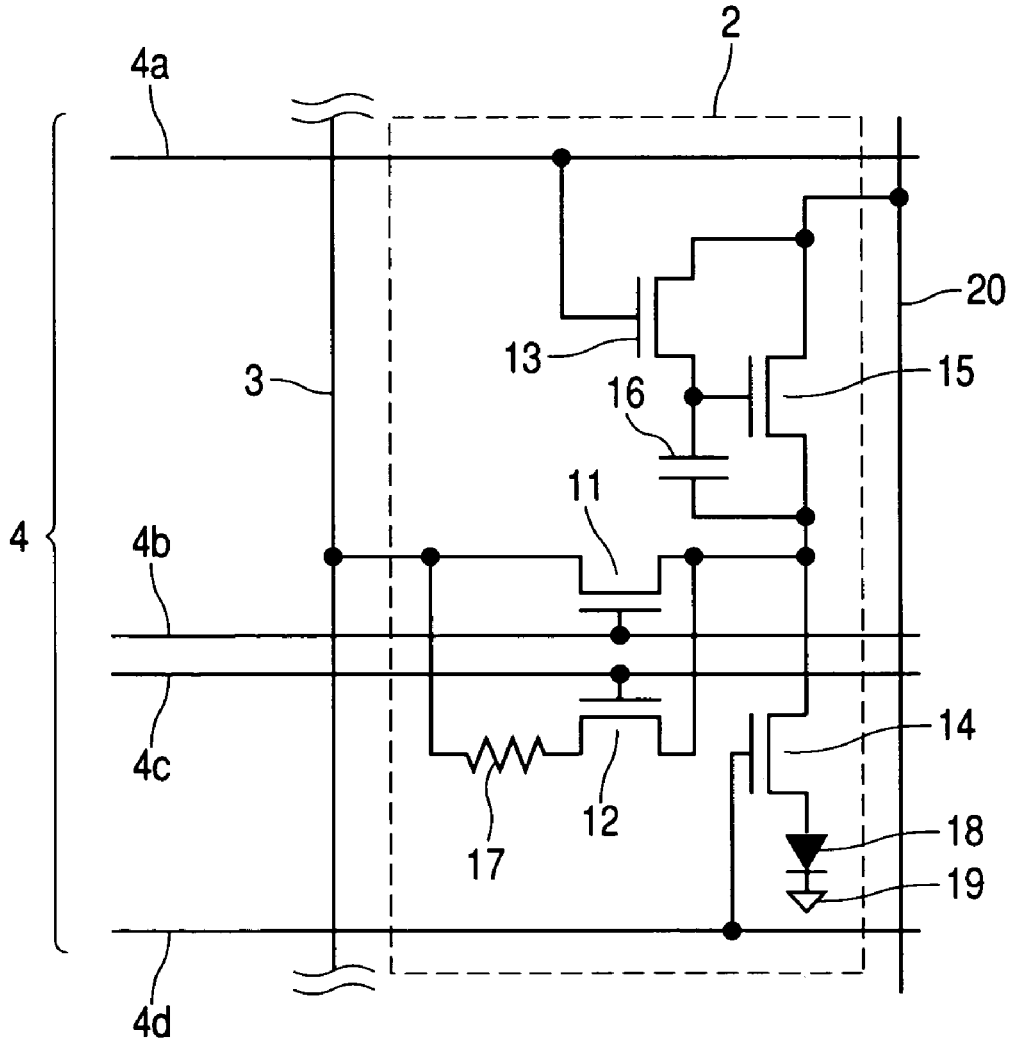
FIG. 2 is a circuit diagram showing a detailed configuration of a pixel circuit shown in FIG. 1.

FIG. 2 is a more detailed circuit diagram of the pixel circuit 2. The connections of a scan bus 4 with the TFT switches 11 to 14 and the power source line 20 are depicted in FIG. 2, though omitted in FIG. 1 because of space limitation. While the current-controlling TFT is depicted in distinction from other TFTs in FIG. 1, these TFTs as well as the current-controlling TFT may be formed as same structures.

In FIG. 2, the TFT switches 11 to 14 and the current-controlling TFT 15 are all configured as n-channel TFTs. A scan bus 4 consists of four scan lines 4*a* to 4*d*. A scan line 4*a* is connected to the gate electrode of the TFT switch 13. A scan line 4*b* is connected to the gate electrode of the TFT switch 11. A scan line 4*c* is connected to the gate electrode of the TFT switch 12. A scan line 4*d* is connected to the gate electrode of the TFT switch 14.

According to n-channel TFT characteristics, the TFT switches 11 to 14 can be programmed to be ON when the voltages on the scan lines 4*a* to 4*d* are high and OFF when the voltages on the scan lines 4*a* to 4*d* are low. The power source line 20 runs on the edges of the pixel circuits as a common line to connect to and supply current to all the pixel circuits 2. If the display device displays in color, separate power source lines would be provided to apply different supply voltages to red, blue, and green pixels, respectively.

Figure 3:
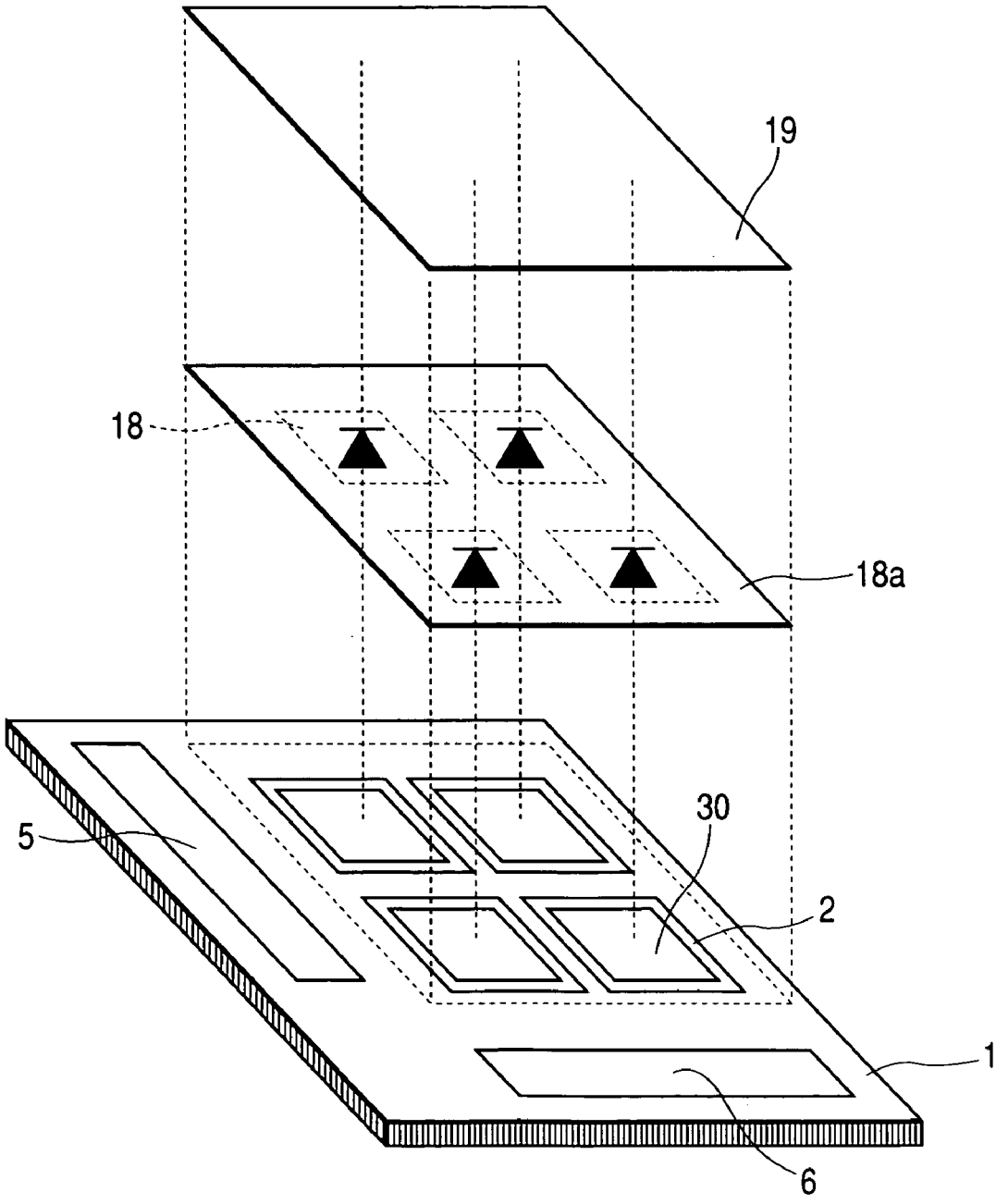
FIG. 3 is a diagram showing a solid structure comprising EL elements and a ground electrode of Embodiment 1.

While the EL element 18 and the ground electrode 19 are depicted as being included in each pixel circuit 2 in FIGS. 1 and 2, the EL element 18 per pixel and the ground electrode 19 are positioned on different levels above the glass substrate 1 in a three dimensional view shown in FIG. 3. Within each pixel circuit 2, an anode electrode 30 connected to the TFT switch 14 is formed and a layer of EL element material 18*a* is deposited on the glass substrate 1 by an evaporation technique. Moreover, on top of this layer, the ground electrode 19 is deposited by the evaporation technique. The EL elements 18 are formed, sandwiched between the anode electrodes 30 and the ground electrode 19. If the display device displays in color, a plurality of EL element materials 18*a* for red, blue, and green are used. When current is allowed to flow between each anode electrode 30 and the ground electrode 19, each EL element 18 emits light. If the ground electrode is made transparent, the top surface of the depicted solid structure of FIG. 3 will function as the display surface. If the anode electrodes are made transparent, the under surface of the foregoing structure will function as the display surface.

Figure 4:
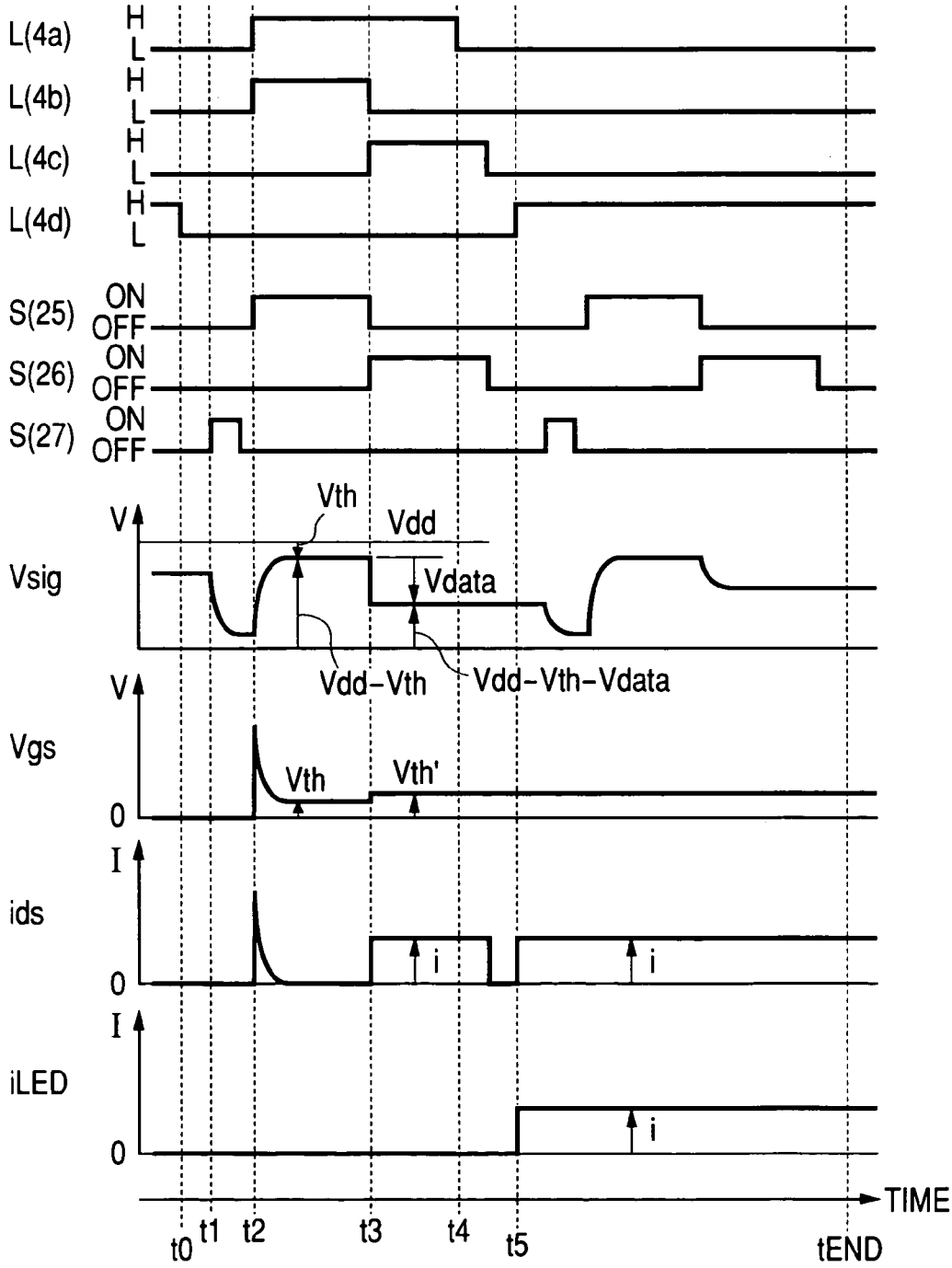
FIG. 4 is a timing chart of the waveforms of drive signals, ON/OFF operations of switches, and voltages and currents generated in the circuitry of Embodiment 1.

FIG. 4 shows the waveforms of drive signals on a scan buses 4, ON/OFF operations of the switches on the driver IC 6, and voltages and currents generated in the internal circuitry of the display device to drive the image display device of Embodiment 1. The following explanation for FIG. 4 will be made, assuming an instance of driving a top left pixel circuit typical of the plurality of pixel circuits 2 shown in FIG. 1.

L(4*a*), L(4*b*), L(4*c*), and L(4*d*) represent the waveforms of drive signals which the scanning circuit generates and outputs to the scan lines 4*a* to 4*b*, respectively. The signals of L(4*a*) to L(4*d*) are two-value logic voltage signals. During a high voltage signal state (hereinafter abbreviated to H), the associated TFT switch is ON. During a low voltage signal state (hereinafter abbreviated to L), the associated TFT switch is OFF. S(25) S(26), and S(27) represent transition of the ON/OFF states of the switches 25 to 27 included in the driver IC 6, respectively.

Vsig represents a voltage on the relevant signal line 3. Vgs represents a gate-source voltage of the current-controlling TFT 15. ids represents a drain-source current of the current-controlling TFT 15. iLED represents a current flowing across the light emitting element 18.

For all in the chart of FIG. 4, time is given on the abscissa. During a period from time t0 to t5, an image signal is written to the top left pixel circuit 2 in FIG. 1. During a period from time t5 to tEND, the light emitting element 18 emits light in accordance with the image signal written to the top left pixel circuit 2.

During the t0 to t5 period, the scan line 4*d* is placed in L and the TFT switch 14 is placed in the OFF state and, therefore, the light emitting element 18 is off.

At time t1, when the switch 27 is turned ON and stays in the ON state for an appropriate period of time, the voltage on the signal line 3 becomes sufficiently lower than the voltage Vdd on the power source line 20. Even after the switch 27 is turned OFF, the signal line 3 remains in this low voltage state due to its parasitic capacitance.

At time t2, the signals on the scan lines 4*a* and 4*b* are turned to H and the switch 25 is turned ON. At this time, the switch TFTs 13 and 12 are placed in the ON state. Because the TFT 13 is placed in the ON state, the voltage Vdd on the power source line 20 is supplied to the gate electrode of the current-controlling TFT 15. Because the TFT 12 is placed in the ON state, the voltage Vsig on the signal line 3 is supplied to the source electrode of the current-controlling TFT 15. Because the voltage Vsig on the signal line is sufficiently lower than the voltage Vdd on the power source line, the gate-source voltage Vgs becomes high enough to turn the current-controlling TFT 15 ON and, consequently, the drain-source current ids flows across the current-controlling TFT 15. As the parasitic capacitance of the signal line 3 is charged over time, the voltage Vsig on the signal line 3 rises and the gate-source voltage Vgs of the current-controlling TFT 15 drops down to a threshold voltage Vth of the current-controlling TFT 15, when the current ids becomes 0 and stable.

At this time, the voltage on the signal line 3 Vsig=Vdd−Vth and the voltage Vdd−Vth is applied to the capacitor 24 through the switch 25 in the driver IC 6. In other words, in Embodiment 1, the pixel circuit operation between time t2 and t3 is to detect the threshold voltage Vth of the current-controlling TFT 15 and convey this voltage to the driver IC 6.

At time t3, the signal on the scan line 4*b* is turned to L, the signal on the scan line 4*c* is turned to H, the switch 25 is turned OFF, and the switch 26 is turned ON. At this time, the TFT switch 11 is placed in the OFF state and the TFT switch 12 is placed in the ON state. In the driver IC 6, because the switch 25 is placed in the OFF state, the capacitor 24 holds the voltage Vdd−Vth. The adder circuit 23 adds the voltage Vdd−Vth on the capacitor 24 and the image signal output voltage −Vdata from the DA converter 22, and the output voltage Vo from the adder circuit 23 becomes Vdd−Vth−Vdata.

Because the switch 26 is placed in the ON state, the output voltage Vo of the adder circuit 23 is output to the signal line 3 and the voltage Vsig on the signal line becomes Vdd−Vth−Vdata that is lower by Vdata than the voltage before time t3. In other words, in Embodiment 1, the pixel circuit operation between time t3 and t4 is to add the voltage −Vdata to the voltage Vsig on the signal line before time t3.

On the other hand, because the TFT 11 has now been placed in the OFF state and the TFT 12 in the ON state in the pixel circuit 2, the source electrode of the current-controlling TFT 15 connects to the signal line 3 via the resistor 17. Because the voltage Vsig on the signal line has become lower than the voltage before time t3, the current starts to flow again across the current-controlling TFT 15. Given that the gate-source voltage at this time is Vgs=Vth', voltage at the source electrode becomes Vdd−Vth'. Thus, a voltage equaling difference between the voltage at the source electrode and the voltage Vsig on the signal line 3, that is, Vdata−(Vth'−Vth), is generated across the resistor 17. Consequently, according to the Ohm's Law, current i that is obtained by Equation 2 below flows across the resistor 17. The drain-source current ids of the current-controlling TFT also becomes equaling to the current i. In Equation 2, R is the resistance value of the resistor.

$$i = V\text{data}\ \{1-(Vth'-Vth)/V\text{data}\}/R \qquad \text{(Equation 2)}$$

At time t4, when the signal on the scan line 4*a* is turned to L, the TFT switch 13 is turned OFF and the gate-source voltage Vgs=Vth' of the current-controlling TFT 15 is held by the capacitor 16. Then, the signal on the scan line 4*c* is turned to L and the switch 26 is turned OFF.

During the period from time t5 to tEND, the signal on the scan line 4*d* remains at H and the TFT switch 14 remains in the ON state. The current is supplied through the current-controlling TFT 15 to the EL element 18 and the EL element 18 emits light. (During this period, the driver IC 6 may write an image signal to another pixel.) At this time, the drain-source current ids of the current-controlling TFT 15 is restricted to the current i due to the gate-source voltage Vgs=Vth' held on the current capacitor 16. Consequently, the current iLED flowing across the EL element 18 is also restricted to the current i.

Since the intensity of light emission of the EL element 18 is proportional to the current iLED, this intensity is also proportional to the current i. Thus, the intensity of light emission of the EL element 18 can be controlled by the voltage Vdata that corresponds to the data of the image signal.

By repeating the above operations to all pixels, the intensity of light emission of the pixels can be controlled in accordance with the image signal. Thus, the image display device of Embodiment 1 of the present invention is able to display an image.

By the way, in the foregoing Equation 2, by making the amplitude of the voltage Vdata sufficiently greater than the voltage (Vth'−Vth), Equation 2 can be approximated to Equation 3.

$$i = V\text{data}/R \qquad \text{(Equation 3)}$$

Here, the right-hand side merely contains the voltage Vdata and the resistance value R of the resistor 17. As implied from this equation, by forming the resistor 17 having a stable resistance value by way of wiring formed with polycrystalline silicon and the like, it can be ensured that the current i will be proportional to the voltage Vdata without being affected by the voltage Vdd on the power source line 20 and the threshold voltage Vth of the current-controlling TFT 15.

Accordingly, the light emitting brightness of the EL elements 18 as constituents of the image display device of Embodiment 1 of the present invention is immune to fluctuation of the power source voltage Vdd and variations of Vth of the current-controlling TFTs.

The image display device set forth in Embodiment 1 may be applied to a mobile phone, TV, PDA, notebook PC, or monitor. In the mobile phone, TV, PDA, notebook PC, or monitor, the image display device that reduces variations in brightness of the light emitting elements due to a voltage drop on the power source line and TFT threshold voltage variations and displays good quality images can be realized.

<Embodiment 2>

Figure 5:
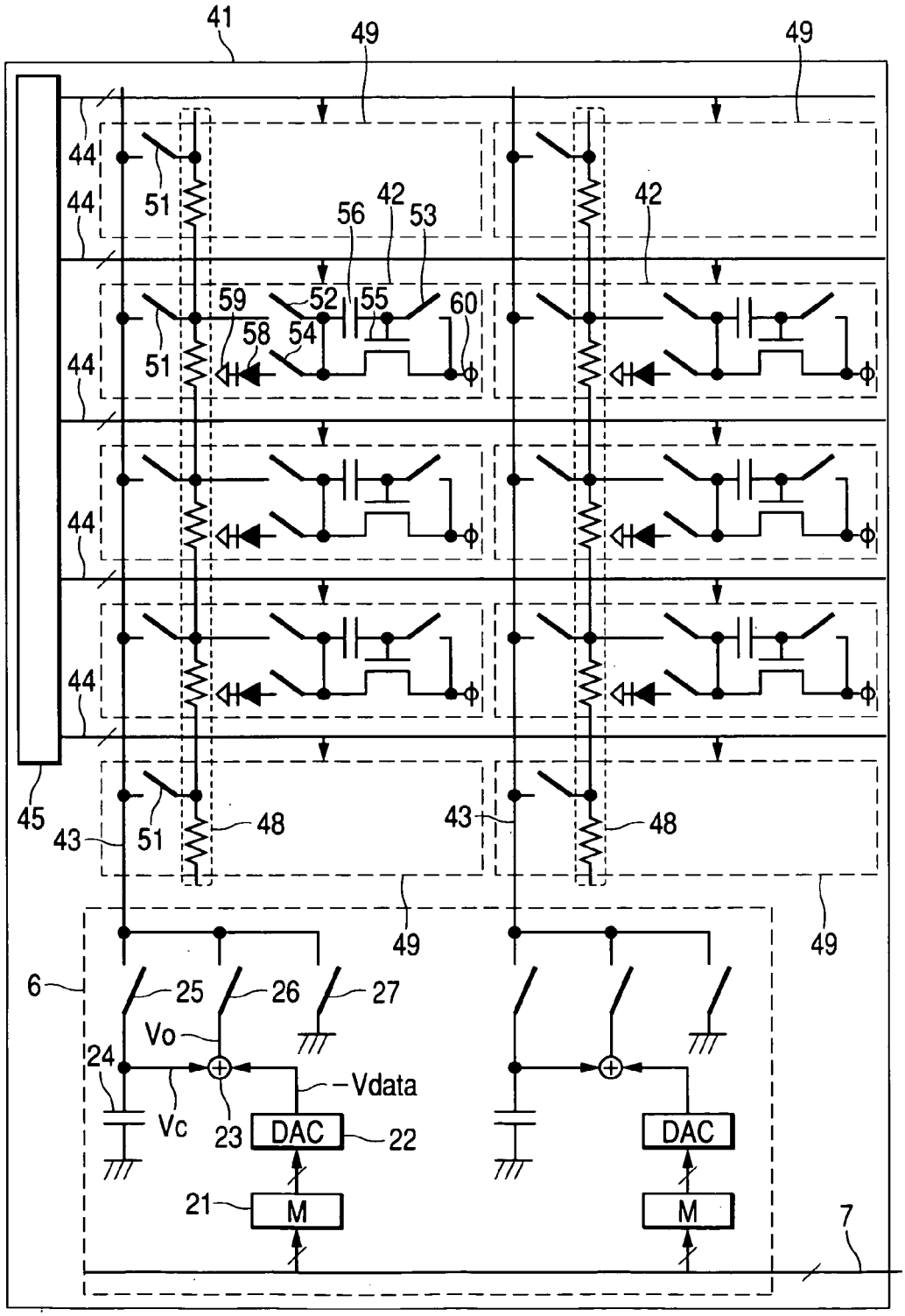
FIG. 5 is a circuitry diagram showing a preferred Embodiment 2 of the image display device according to the present invention.

FIG. 5 is a circuitry diagram showing a preferred Embodiment 2 of the image display device according to the present invention. On a glass substrate 41, a plurality of pixel circuits 42, a plurality of dummy pixel circuits 49, a plurality of signal lines 43, a plurality of resistive wiring lines 48, a plurality of scan buses 44, and a scanning circuit 45 are formed. The pixel circuits 42 are arranged in a matrix of two columns by three rows. The reason why the number of the pixel circuits 42 is 2×3=6 is merely for simplifying explanation. For, for example, a screen resolution of the color VGA, the number of pixels could be 1920 columns (640 columns×3 colors) by 480 rows. Each signal line 43 and each resistive wiring line 48 are connected to individual pixel circuits 42 and dummy pixel circuits 49 arranged in one column and each scan bus 44 is connected to individual pixel circuits 42 and dummy pixel circuits 49 arranged in one row. The scanning circuit 45 has connections to all the scan buses 44 and outputs signals to the scan buses 44. In addition, a driver IC 6 is bonded on the surface of the glass substrate 41 and has connections to the signal lines 43. The driver IC 6 receives an image signal that is input from the external through a cable 7.

A pixel circuit 42 is comprised of TFT switches 51 to 54, a current-controlling TFT 55, a capacitor 56, and an EL element 58. The capacitor 56 is connected between the gate electrode and the source electrode of the current-controlling TFT 55 and has a function to hold a gate-source voltage Vgs. A TFT switch 53 is connected between the drain and gate electrodes of the current-controlling TFT 55 and controls whether to supply a voltage on the drain electrode to the gate electrode and the capacitor 16. The drain electrode of the current-controlling TFT 55 is connected to a power source line 60 and is supplied with current from the power source line 60.

The source electrode of the current-controlling TFT 55 is connected to two TFT switches 52 and 54. A TFT switch 52 makes a connection between one of the resistive wiring lines 48 and the current-controlling TFT 55 and takes a role to allow current that flows through the current-controlling TFT 15 to flow directly into the resistive wiring line 48 when it is ON. A TFT switch 54 makes a connection between the anode of the EL element 58 and the current-controlling TFT 55 and takes a role to supply the current flowing through the current-controlling TFT 15 to the EL element 58 when it is ON. The cathode of the EL element 58 is connected to a ground electrode 59.

A TFT switch 51 makes a connection between a node of connection to the TFT switch 52, the node being located on the resistive wiring line 48, and the associated signal line 43, and takes role to allow the current flowing through the TFT switch 52 to flow into the signal line 43. A dummy pixel circuit 49 has only a TFT switch 51 that takes a role to allow current flowing through the resistive wiring line 48 to flow into the signal line 43 when it is ON.

While the current-controlling TFT is depicted in distinction from other TFTs in FIG. 5, these TFTs as well as the current-controlling TFT may be formed as same structures. The TFT switches 51 to 54 and the current-controlling TFT 55 are all configured as n-channel TFTs.

Although omitted in FIG. 5, it is assumed that the TFT switches 51 to 54 are connected to a scan bus 44 and ON/OFF states of the switches are controlled by a signal carried on the scan bus 44. All the plurality of scan busses 44 are connected to the scanning circuit 45 and the scanning circuit 45 has a function to generate logic signals to control ON/OFF of the TFT switches 51 to 54 and supply these signals through the scan busses 44.

The driver IC 6 is comprised of memory elements 21, DA converters 22, adder circuits 23, capacitors 24, and switches 25 to 27. The driver IC 6 has the connections to all the signal lines 43 and is made up of same parallel circuit arrangements per signal line. All the plurality of memory elements 21 are connected to the cable 7 and have a function to distribute and store a digital image signal that is input through the cable 7. A DA converter 22 is connected to a memory element 21 and has a function to convert a digital image signal stored on the memory element 21 into an analog voltage. A capacitor 24 and a switch 25 constitute a sampling circuit and the capacitor 24 takes a role to sample and hold a voltage on the signal line 43 when the switch 25 is ON. An adder circuit 23 adds an output voltage "−Vdata" from the DA converter 22 and a voltage Vc on the capacitor 24 and generates a sum voltage Vo. A switch 26 makes a connection between the adder circuit 23 and the signal line 43 and the sum voltage Vo is output to the signal line 43 when the switch 26 is ON. A TFT 27 is a switch to drop the voltage on the signal line 43 to a voltage that is sufficiently lower than a voltage on the power source line 60. All or part of the functions of the memory elements 21, DA converters 22, adder circuits 23, capacitors 24, and switches 25 to 27 constituting the driver IC 6 may be configured with TFTs and formed on the glass substrate 41.

Figure 6:
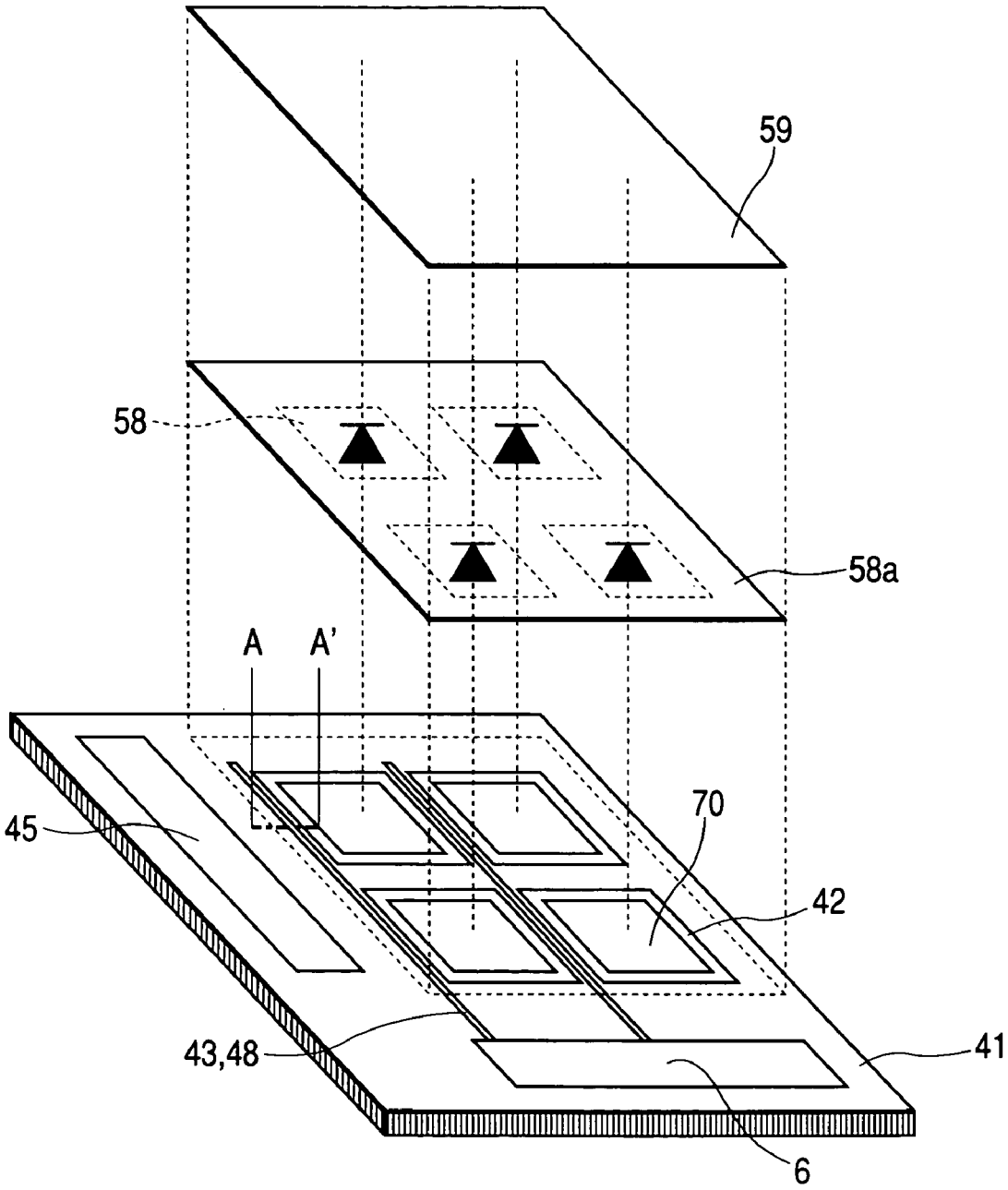
FIG. 6 is a diagram showing a solid structure comprising EL elements, a ground electrode, signal lines, and resistive wiring lines of Embodiment 2.

While the EL element 58 and the ground electrode 59 are depicted as being included in each pixel circuit 42 in FIG. 5, the EL element 58 per pixel and the ground electrode 59 are positioned on different levels above the glass substrate in a three dimensional view shown in FIG. 6. Within each pixel circuit 42, an anode electrode 70 connected to the TFT switch 54 is formed and a layer of EL element material 58*a* is deposited on the glass substrate 41 by an evaporation technique. Moreover, on top of this layer, the ground electrode 59 is deposited by the evaporation technique. The EL elements 58 are formed, sandwiched between the anode electrodes 70 and the ground electrode 59. If the display device displays in color, a plurality of EL element materials 58*a* for red, blue, and green are used. When current is allowed to flow between each anode electrode 70 and the ground electrode 59, each EL element 58 emits light. If the ground electrode is made transparent, the top surface of the depicted solid structure of FIG. 6 will function as the display surface. If the anode electrodes are made transparent, the under surface of the foregoing structure will function as the display surface.

Figure 7:
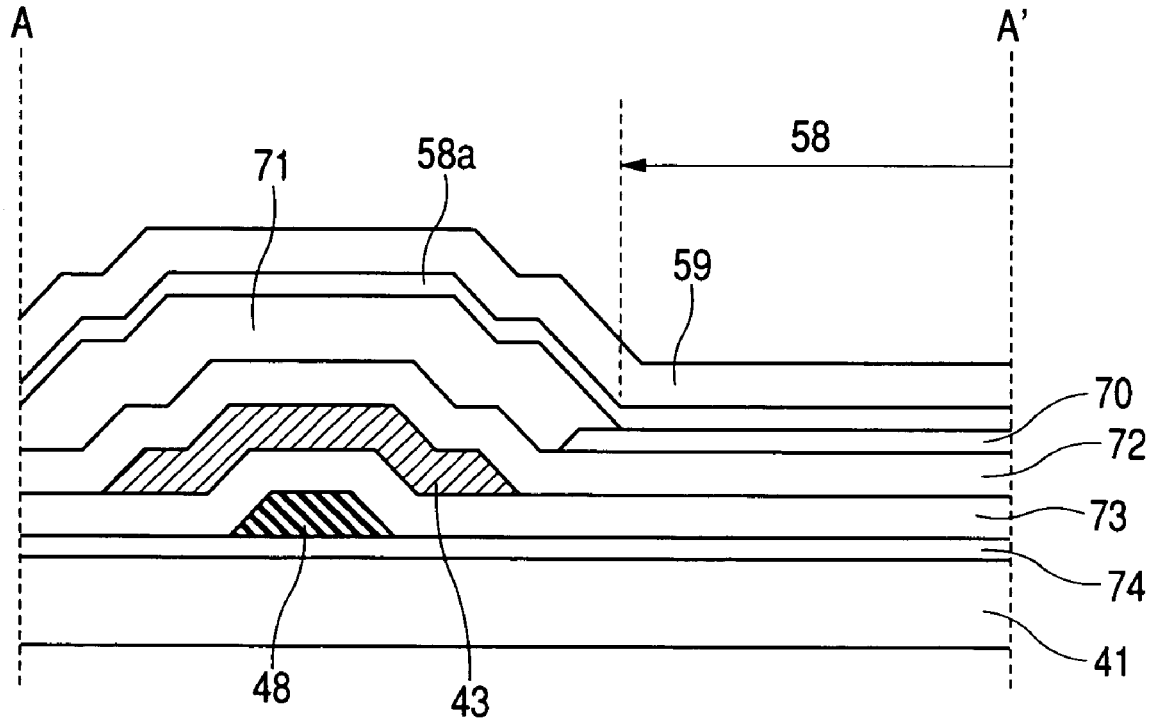
FIG. 7 is a cross-sectional view of section A–A' shown in FIG. 6.

By the way, a signal line 43 and a resistive wiring line 48 can be formed so as to be overlapped in a region on the glass substrate 41. FIG. 7 shows a cross-sectional view of section A–A' in FIG. 6. An insulation layer 74 is formed on the glass substrate 41 and, on the insulation layer 74, the resistive wiring line 48 made of a polycrystalline silicon thin film doped with either phosphorus or boron is formed. On top of that, an insulation layer 73 is formed and, then, the signal line 43 made of highly conductive metal such as aluminum is formed. On top of that, an insulation layer 72 is formed and, then, the anode electrode 70 is formed, which is covered with an insulation layer 71. On top of that, the EL element material 58*a* is deposited, on which the ground electrode 59 is further deposited. Forming the resistive wiring line 48 and the signal line 43 overlapped in a region can make room for a greater area of the EL element 58 formed of the EL element material 58*a* deposited on the anode electrode 70. Therefore, this is advantageous in providing the image display device with a capability of brighter light emission.

Figure 8:
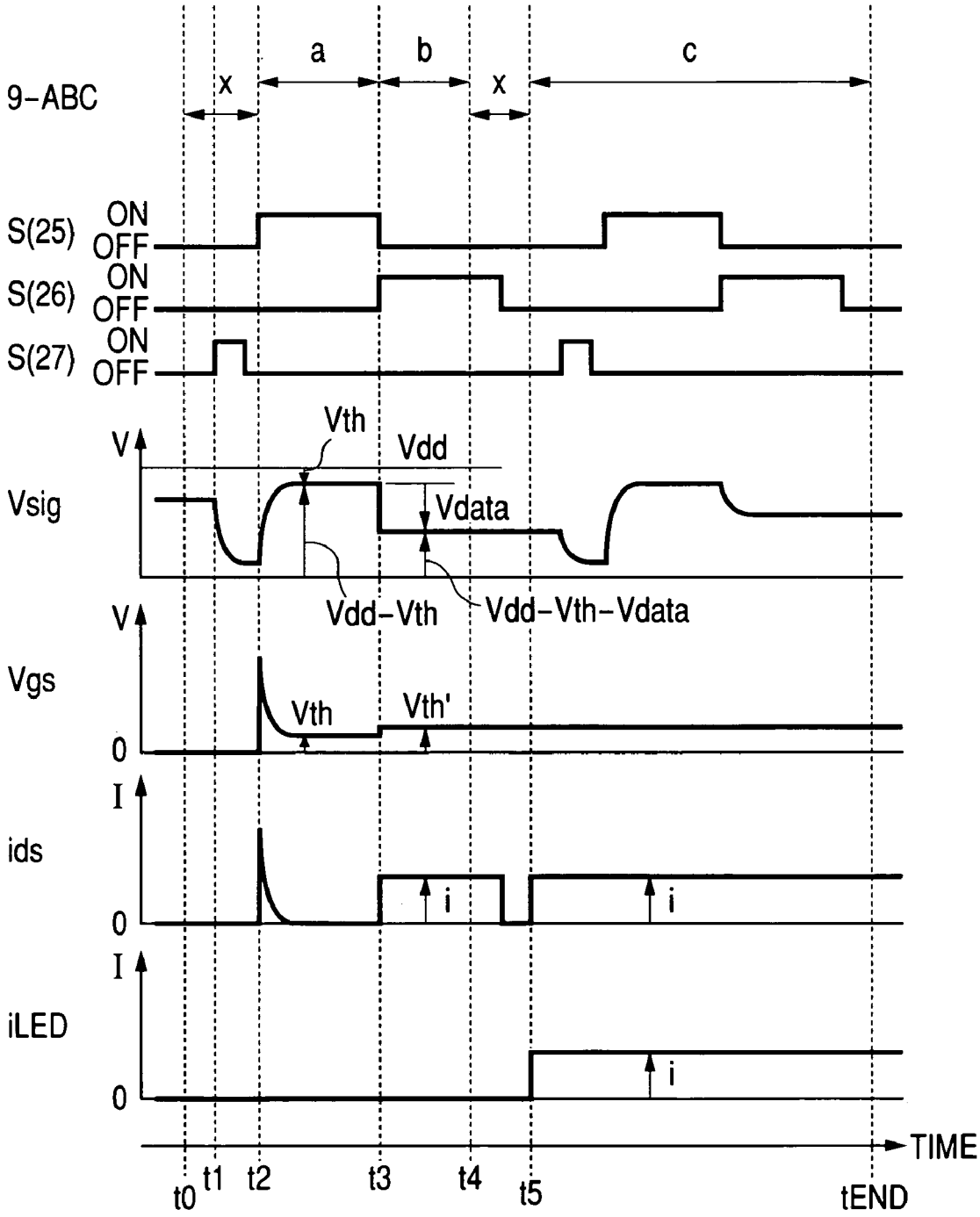
FIG. 8 is a timing chart of the waveforms of drive signals, ON/OFF operations of TFT switches, and voltages and currents generated in the circuitry of Embodiment 1.
Figure 9A:
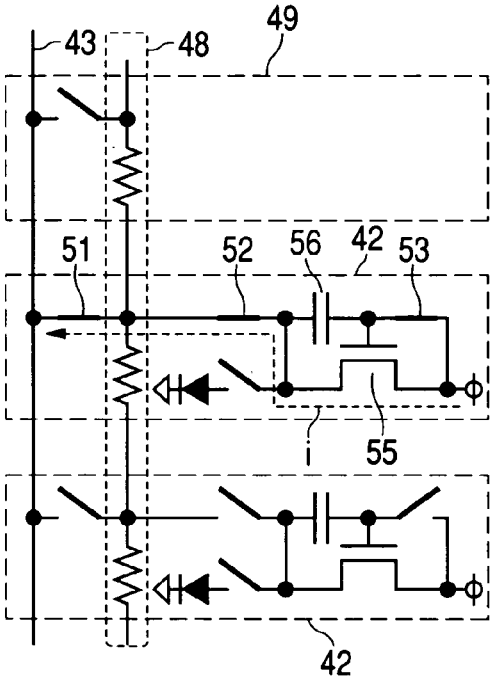
FIGS. 9A to 9C are diagrams representing the changing states of the TFT switches.
Figure 9B:
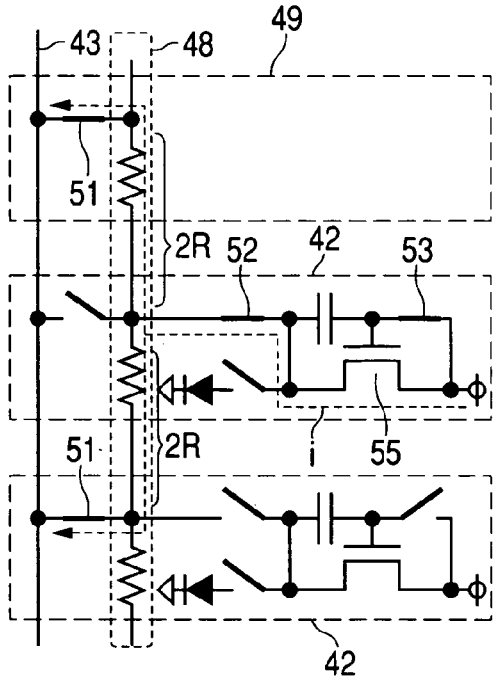
Figure 9C:
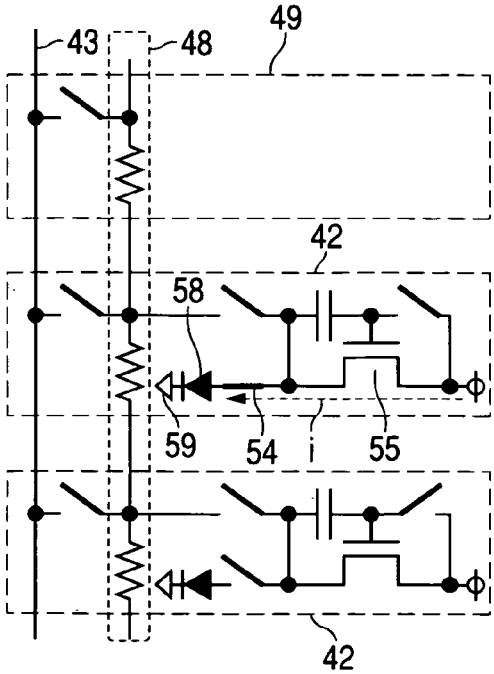

FIG. 8 shows the ON/OFF operations of the TFT switches 51 to 54, ON/OFF operations of the switches on the driver IC 6, and voltages and currents generated in the internal circuitry of the display device to drive the image display device of Embodiment 2. The following explanation for FIG. 8 will be made, assuming an instance of driving a top left pixel circuit typical of the plurality of pixel circuits 42 shown in FIG. 5. Marked periods in 9-ABC represent different states of the TFT switches 51 to 54; periods "a," "b," and "c" correspond to the states shown in FIGS. 9A, 9B, and 9C, respectively. FIGS. 9A to 9C are the drawings of the top left pixel circuit and its adjacency extracted from FIG. 5 in the different periods. Period "x" denotes a state that all the TFT switches are OFF (not shown in FIGS. 9A to 9C). S(25), S(26), and S(27) in FIG. 8 represent transition of the ON/OFF states of the switches 25 to 27 included in the driver IC 6, respectively. Vsig represents a voltage on the relevant signal line 43. Vgs represents a gate-source voltage of the current-controlling TFT 55. ids represents a drain-source current of the current-controlling TFT 55. iLED represents a current flowing across the light emitting element 58.

For all in the chart of FIG. 8, time is given on the abscissa. During a period from time t0 to t5, an image signal is written to the top left pixel circuit 42 in FIG. 5. During a period from time t5 to tEND, the light emitting element 58 emits light in accordance with the image signal written to the top left pixel circuit 42.

During the t0 to t5 period, all TFT switches are in the OFF state and the light emitting element 58 is off.

At time t1, when the switch 27 is turned ON and stays in the ON state for an appropriate period of time, the voltage Vsig on the signal line 43 becomes sufficiently lower than the voltage Vdd on the power source line 60. Even after the switch 27 is turned OFF, the signal line 43 remains in this low voltage state due to its parasitic capacitance.

At time t2, the TFT switches 51 to 53 in the pixel circuit 42 to be driven are turned ON, as shown in FIG. 9A. Because the TFT 53 is placed in the ON state, the voltage Vdd on the power source line 60 is supplied to the gate electrode of the current-controlling TFT 55. Because the TFT 52 is placed in the ON state, the voltage Vsig on the signal line is supplied to the source electrode of the current-controlling TFT 55. Because the voltage Vsig on the signal line is sufficiently lower than the voltage Vdd on the power source line, the gate-source voltage Vgs becomes high enough to turn the current-controlling TFT 55 ON and, consequently, the drain-source current ids of the current-controlling TFT 55 flows as indicated by a dotted arrow line in FIG. 9A.

As the parasitic capacitance of the signal line 43 is charged over time, the voltage Vsig on the signal line 43 rises and the gate-source voltage Vgs of the current-controlling TFT 55 drops down to a threshold voltage Vth of the current-controlling TFT 55, when the current ids becomes 0 and stable. At this time, the signal line voltage Vsig=Vdd−Vth and the voltage Vdd−Vth is applied to the capacitor 24 through the switch 25 in the driver IC 6. In other words, in Embodiment 2, the pixel circuit operation between time t2 and t3 is to detect the threshold voltage Vth of the current-controlling TFT 55 and convey this voltage to the driver IC 6.

At time t3, the TFT switch 51 in the pixel circuit 42 (or the dummy pixel circuit 49) on row above the pixel circuit 42 to be driven and the TFT switch 51 in the pixel circuit 42 one row below the pixel circuit 42 to be driven are turned ON, as shown in FIG. 9B. In the driver IC 6, because the switch 25 is placed in the OFF state, the capacitor 24 holds the voltage Vdd−Vth. The adder circuit 23 adds the voltage Vdd−Vth on the capacitor 24 and the image signal output voltage −Vdata from the DA converter 22, and the output voltage Vo from the adder circuit 23 becomes Vdd−Vth−Vdata. Because the switch 26 is placed in the ON state, the output voltage Vo of the adder circuit 23 is output to the signal line 43 and the voltage Vsig on the signal line becomes Vdd−Vth−Vdata that is lower by Vdata than the voltage before time t3. In other words, in Embodiment 2, the pixel circuit operation between time t3 and t4 is to add the voltage −Vdata to the voltage Vsig on the signal line before time t3.

Because the voltage Vsig on the signal line has become lower than the voltage before time t3, the current starts to flow again across the current-controlling TFT 55. At this time, the current flows on the route indicated by a dotted arrow line in FIG. 9B. Given that the resistance of a section of the resistive wiring line 48 as long as a vertical pitch of pixel circuit to pixel circuit (or a dummy pixel circuit) is 2R, the resistance on the current route between the signal line 43 and the current-controlling TFT 55 becomes parallel resistances of 2R and the resistance value becomes R. Besides, given that the gate-source voltage of the current-controlling TFT at this time is Vgs=Vth', voltage at the source electrode becomes Vdd−Vth'. Thus, a voltage equaling difference between the voltage at the source electrode and the voltage Vsig on the signal line 43, that is, Vdata−(Vth'−Vth), is generated on the resistive wiring line 48. Consequently, according to the Ohm's Law, current i that is obtained by Equation 4 below flows through the resistive wiring line 48. The drain-source current ids of the current-controlling TFT also becomes equaling to the current i.

$$i = V\text{data}\ \{1-(Vth'-Vth)/V\text{data}\}/R \qquad \text{(Equation 4)}$$

At time t4, when all the TFT switches are turned OFF, the gate-source voltage Vgs=Vth' of the current-controlling TFT 55 is held by the capacitor 56.

During the period from time t5 to tEND, the TFT switch 54 in the pixel circuit 42 to be driven is set in the ON state, as shown in FIG. 9C. The current is supplied through the current-controlling TFT 55 to the EL element 58 and the EL element 58 emits light. (During this period, the driver IC 6 may write an image signal to another pixel.) At this time, the drain-source current ids of the current-controlling TFT 55 is restricted to the current i due to the gate-source voltage Vgs=Vth' held on the current capacitor 56. Consequently, the current iLED flowing across the EL element 58 is also restricted to the current i.

Since the intensity of light emission of the EL element 58 is proportional to the current iLED, the light emitting brightness of the EL element 58 is also proportional to the current i. Thus, the light emitting brightness of the EL element 58 can be controlled by the voltage Vdata that corresponds to the data of the image signal.

By repeating the above operations to all pixels, the light emitting brightness of the pixels can be controlled in accordance with the image signal. Thus, the image display device of Embodiment 2 is able to display an image.

By the way, in Equation 4, by making the amplitude of the voltage Vdata sufficiently greater than the voltage (Vth'−Vth), Equation 4 can be approximated to Equation 5.

$$i = V\text{data}/R \qquad \text{(Equation 5)}$$

Here, the right-hand side merely contains the voltage Vdata and the resistance value R that is obtained from the resistance value of the resistive wiring line 48. As implied from this equation, by forming the resistive wiring line 48 having a stable resistance value, it can be ensured that the current i will be proportional to the voltage Vdata without being affected by the voltage Vdd on the power source line 60 and the threshold voltage Vth of the current-controlling TFT 55. Accordingly, the intensity of light emission of the EL elements 58 as constituents of the image display device of Embodiment 2 is immune to fluctuation of the power source voltage Vdd and variations of Vth of the current-controlling TFTs.

The image display device set forth in Embodiment 2 may be applied to a mobile phone, TV, PDA, notebook PC, or monitor. In the mobile phone, TV, PDA, notebook PC, or monitor, the image display device that reduces variations in brightness of the light emitting elements due to a voltage drop on the power source line and TFT threshold voltage variations and displays good quality images can be realized.

<Embodiment 3>

In the following, a preferred Embodiment 3 of the invention will be described, involving an example of modification to Embodiments 1 and 2 and an adder circuit configuration example.

While all the TFTs in an pixel circuit are n-channel TFTs in Embodiments 1 and 2 described hereinbefore, it is obvious that the above TFTs can be configured as p-channel TFTs by reversing the voltage polarity at all nodes, the direction of current, and the anode and cathode of an EL element.

Figure 10:
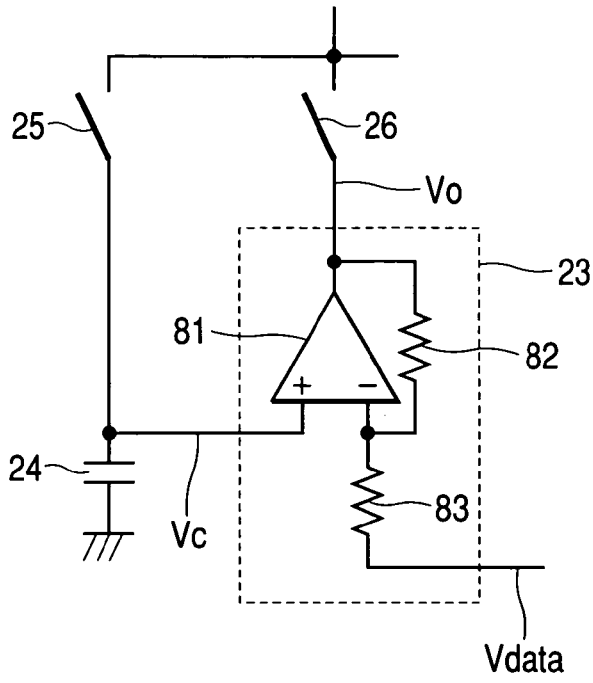
FIG. 10 is a circuit diagram of an adder circuit used in Embodiments 1 and 2.

FIG. 10 shows the configuration of the adder circuit 23 used in the above Embodiments 1 and 2. The adder circuit 23 is comprised of an op-amp circuit 81 and resistors 82 and 83 having a resistance value of r. The adder circuit 23 generates a voltage that is obtained by Equation 6 below as the output voltage Vo.

$$Vo=Vc-(r/r)V\text{data}=Vc-V\text{data} \quad \text{(Equation 6)}$$

Thus, the adder circuit shown in FIG. 10 is able to add the voltage −Vdata and the voltage Vc on the capacitor 24.

Figure 11:
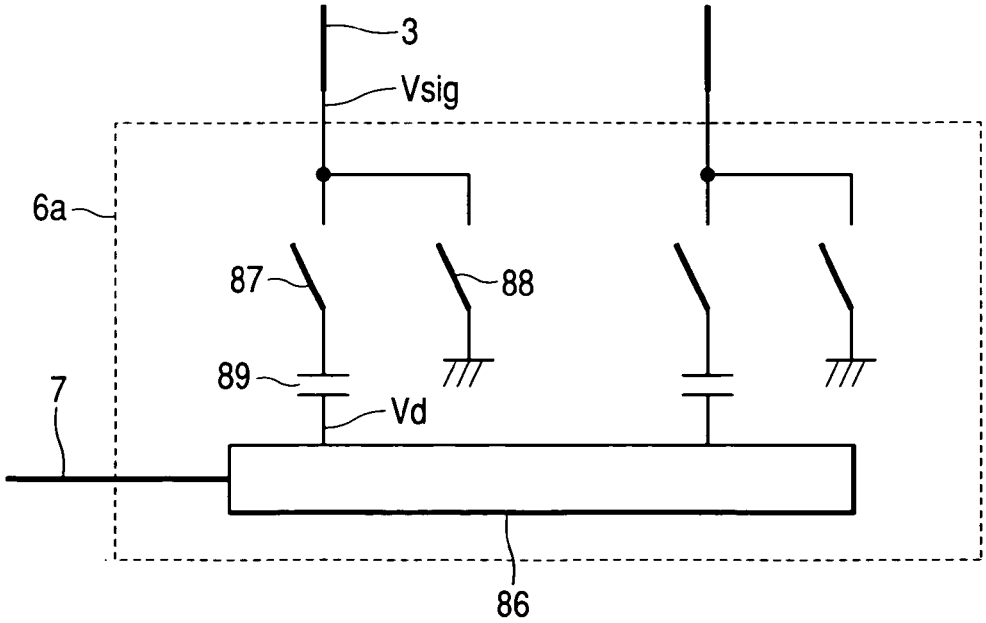
FIG. 11 is a diagram showing a circuit alternative to a driver IC used in Embodiments 1 and 2.

FIG. 11 shows a circuit alternative to the driver IC 6 used in the above Embodiments 1 and 2. Instead of the driver IC 6, a driver circuit 6*a* can be used. The driver circuit 6*a* is comprised of an analog voltage output driver IC 86 which is used for a conventional liquid crystal display and the like, TFT switches 87 and 88, and capacitors 89. A TFT switch 88 is a switch to drop the voltage on the associated signal line 3 to a lower voltage and functions the same as a switch 27 in FIGS. 1 and 5. The TFT switch 87 makes a connection between the signal line 3 and the capacitor 89 and is turned ON so that the output voltage of the driver IC 86 is added to the voltage on the signal line 3.

Figure 12:
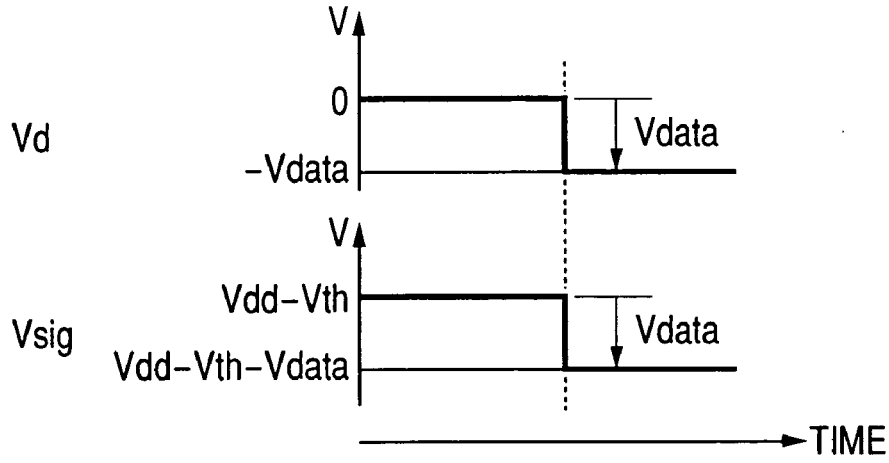
FIG. 12 is a diagram showing signal line voltage response to change in the driver output voltage.
Figure 13:
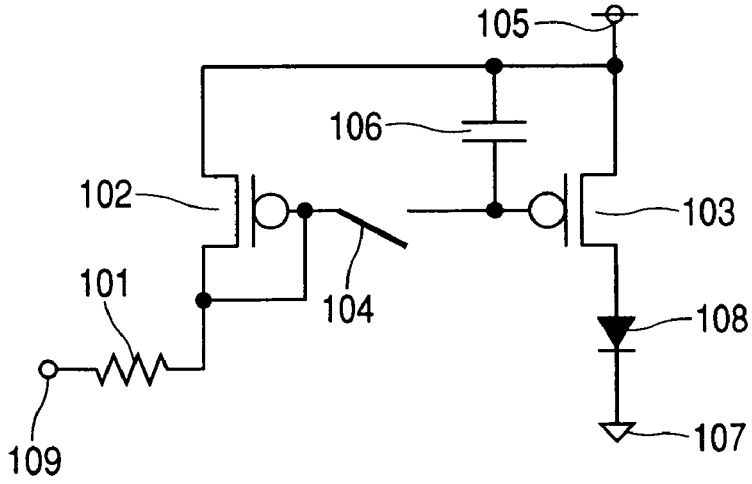
FIG. 13 PRIOR ART
FIG. 13 is a diagram showing an example of a conventional pixel circuit equipped with an EL element.

FIG. 12 is a diagram showing response of the signal line voltage Vsig to change in the driver output voltage Vd. When the TFT switch 87 is placed in the ON state, the output voltage Vd of the driver IC 86 changes from 0 to −Vdata of an image signal, the signal line voltage Vsig also decreases by Vdata, because the voltage difference between the two terminals of the connected capacitor cannot change rapidly. As for the capacitor 89, a capacitor whose capacitance is sufficiently greater than the parasitic capacitance of the signal line 3 is used. Here, given that the signal line voltage was Vdd−Vth before the TFT switch 87 is turned ON, upon the above switch operation, a new voltage Vdd−Vth−Vdata is generated on the signal line. In other words, this means that the circuit of FIG. 11 is able to add the voltage −Vdata to the voltage on the signal line 3.

What is claimed is:

1. An image display device comprising:

an image display portion in which a plurality of pixels are arranged in a matrix;

a plurality of signal lines wired in said image display portion to carry a voltage signal to said pixels; and a drive circuit to control voltage on each said signal line, wherein each said pixel comprises a light emitting element and a pixel circuit which controls the intensity of light emission of said light emitting element, the image display device is equipped with a pixel circuit voltage detecting circuit for placing the pixel circuit included in each said pixel in at least one of a disconnection state from said signal line, a connection state to said signal line, and resistive connection state wherein said pixel circuit connects to said signal line with a sufficiently higher value of resistance than in said connection state, and the image display device is equipped with a voltage addition means to add the voltage on said signal line and a signal voltage corresponding to image data to be displayed and output a sum voltage to said signal line again.

2. The image display device according to claim 1, wherein: said pixel circuit voltage detecting means comprises a resistor and switching transistors connected in parallel to the resistor.

3. The image display device according to claim 1, wherein: said pixel circuit is equipped with a current holding circuit to supply a constant current to said light emitting element.

4. The image display device according to claim 1, wherein: said drive circuit comprises a sampling circuit to hold the voltage on said signal line and an adder circuit to add the voltage thus held and an image signal voltage.

5. The image display device according to claim 1, wherein: said drive circuit comprises a driver IC to output an analog voltage and a capacitor connected between said driver IC and said signal line.

6. The image display device according to claim 1, wherein: said light emitting element is a light-emitting diode element.

7. The image display device according to claim 1, wherein: said pixel circuit and said pixel circuit voltage detecting means are configured with thin-film transistors.

8. The image display device according to claim 7, wherein: said pixel circuit is configured with either n-channel or p-channel thin-film transistors.

9. An image display device comprising:

an image display portion in which, a plurality of pixels are arranged in a matrix;

a plurality of signal lines wired in said image display portion to carry a voltage signal to said pixels; and a drive circuit to control an analog voltage on each said signal line, wherein each said pixel comprises a light emitting element and a pixel circuit which controls the intensity of light emission of said light emitting element, and the image display device further includes a plurality of resistive wiring lines having a higher value of resistance than said signal lines and wired in parallel with said signal lines, a plurality of first switching means to control connection between each said signal line and each said resistive wiring line, and a plurality of second switching means to control connection between each said resistive wiring line and each said pixel circuit.

10. The image display device according to claim 9, wherein:

said drive circuit is equipped with a voltage addition means to add the voltage on said signal line and a signal voltage corresponding to image data to be displayed and output a sum voltage to said signal line again.

11. The image display device according to claim 9, wherein: the image display device is equipped with a control circuit which controls said first and second switching means to change a value of resistance between said signal line and said pixel circuit in at least two levels.

12. The image display device according to claim 9, wherein: said signal line and said resistive wiring line are formed so as to be overlapped in a region and isolated by an insulation layer which is formed therebetween.

13. The image display device according to claim 9, wherein: said resistive wiring line is made of a polycrystalline silicon thin film.

14. The image display device according to claim 9, wherein: said light emitting element is a light-emitting diode element.

15. The image display device according to claim 9, wherein: said pixel circuit and said first and second switching means are configured with thin-film transistors.

16. The image display device according to claim 15, wherein: said pixel circuit is configured with either n-channel or p-channel thin-film transistors.

* * * * *